US005083877A

United States Patent [19]

Jones

[11] Patent Number: 5,083,877

[45] Date of Patent: Jan. 28, 1992

[54] TAPE FEED CONTROL APPARATUS FOR A CORRECTION TAPE CASSETTE FOR A TYPEWRITER

[75] Inventor: Bruce S. Jones, Franklin, Tenn.

[73] Assignee: Pelikan, Inc., Franklin, Tenn.

[21] Appl. No.: 510,478

[22] Filed: Apr. 18, 1990

[51] Int. Cl.[5] ..... B41J 33/36

[52] U.S. Cl. ..... 400/232; 400/234; 400/697

[58] Field of Search ..... 400/208, 232, 234, 235, 400/235.1, 236, 697, 697.1

[56] References Cited

U.S. PATENT DOCUMENTS

| | | | |
|---|---|---|---|
| 3,348,650 | 10/1967 | Meinherz et al. | 197/151 |
| 3,667,486 | 6/1972 | Cole et al. | 134/45 |
| 3,677,486 | 7/1972 | Findlay | 242/67.4 |
| 3,731,781 | 5/1973 | Caudill et al. | 242/57.1 |
| 3,923,141 | 12/1975 | Hengelhaupt | 242/67.5 |
| 4,239,107 | 12/1980 | Boyatt, Jr. et al. | 400/208.1 |
| 4,247,210 | 1/1981 | Kacmarcik et al. | 400/236 |
| 4,302,118 | 11/1981 | Schaefer | 400/208 |
| 4,329,072 | 5/1982 | Kacmarcik | 400/208 |
| 4,347,007 | 8/1982 | Schaefer | 400/208 |
| 4,350,453 | 9/1982 | Field et al. | 400/208 |
| 4,353,657 | 10/1982 | Schaefer | 400/208 |
| 4,395,149 | 7/1983 | Longrod | 400/215 |
| 4,397,575 | 8/1983 | Aldrich | 400/208 |
| 4,407,593 | 10/1983 | Haftmann | 400/208 |
| 4,475,829 | 10/1984 | Goff, Jr. et al. | 400/232 |
| 4,516,137 | 5/1985 | Yasui | 400/120 |
| 4,611,936 | 9/1986 | Yasui | 400/120 |
| 4,611,938 | 9/1986 | Rettke et al. | 400/212 |
| 4,616,945 | 10/1986 | Komplin | 400/697.1 |
| 4,636,097 | 1/1987 | Goubeaux | 400/196.1 |
| 4,747,714 | 5/1988 | Moritz et al. | 400/214 |
| 4,886,383 | 12/1989 | Mueller | 400/208 |

FOREIGN PATENT DOCUMENTS

| | | |
|---|---|---|
| 2705127 | 10/1977 | Fed. Rep. of Germany . |
| 3346482 | 7/1984 | Fed. Rep. of Germany . |
| 56-148985 | 11/1981 | Japan . |
| 57-17884 | 11/1982 | Japan . |
| 59-78879 | 5/1984 | Japan . |
| 59-93376 | 5/1984 | Japan . |
| 61-31284 | 2/1986 | Japan . |
| 61-146576 | 7/1986 | Japan . |
| 2179917 | 3/1987 | United Kingdom . |

OTHER PUBLICATIONS

W. M. Jenkins, "End-of-Ribbon Sensor and Cartridge-Present Indicator," IBM Technical Disclosure Bulletin, vol. 27, No. 6, Nov. 1988, pp. 3645-3647.

B. D. Purcell, "Stuffer Ribbon Cartridge," IBM Technical Disclosure Bulletin, vol. 25, No. 4, Sep. 1982, pp. 2153-2154.

(List continued on next page.)

*Primary Examiner*—Edgar S. Burr
*Assistant Examiner*—Ren Yan
*Attorney, Agent, or Firm*—John F. A. Earley; John F. A. Earley, III

[57] ABSTRACT

Tape feed control apparatus for a correction tape cassette 11 for a typewriter for controlling the amount of correction tape being fed to a printing point for lifting-off or covering-up a typed character, comprises a housing 13, a post 15 mounted in the housing 13, a brake finger 17 pivotally mounted on post 15 so that an end portion 17*a* of the brake finger 17 is in frictional contact with correction tape 18 on a take-up spool 19 to hold the tape firmly on the take-up spool 19, a spring 20 in contact with brake finger 17 urges a brake finger end portion 17*a* against the tape 18 on the take-up spool 19, an opening 25 in the sidewall 13*a* of housing 13 admits a typewriter metering post 26 into the housing 13, a stop member 27 formed in the housing 13 limits the travel of typewriter metering post 26 into housing 13, the stop member 27 is stationary so that its position does not change in response to the amount of correction tape 18 on the take-up spool 19 so that the distance travelled by the metering post 26 corresponds to a constant amount of rotation of take-up spool 19 no matter whether cover-up correction tape or lift-off correction tape is on spool 19 and so that as more and more correction tape winds around take-up spool 19, more correction tape is advanced for the same amount of rotation of take-up spool 19 so that the spacing between characters on the correction tape increases during the life of correction tape cassette 11.

5 Claims, 1 Drawing Sheet

OTHER PUBLICATIONS

D. J. Winarski, "Web-Guiding Stress Functions," IBM Technical Disclosure Bulletin, vol. 24, No. 4, Sep. 1982, p. 2069.

J. W. Wenner, "Constant Head Wrap Tape Drive," IBM Technical Disclosure Bulletin, vol. 25, No. 4, Sep. 1982, p. 2068.

M. H. Buchholz and R. W. Lissner, "Web-Tension Sensing Devices," IBM Technical Disclosure Bulletin, vol. 25, No. 4, Sep. 1982, pp. 2066-2067.

W. D. Thorne, "Page Width Ribbon Cartridge and Drive Mechanism," IBM Technical Disclosure Bulletin, vol. 25, No. 4, Sep. 1982, pp. 2020-2022.

J. A. Craft, "Low Cost Cartridge Code Detector," IBM Technical Disclosure Bulletin, vol. 25, No. 4, Sep. 1982, pp. 1980-1981.

N. D. Dunning and N. E. Hosie, "Protective Carton", IBM Technical Disclosure Bulletin, vol. 25, No. 4, Sep. 1982, pp. 1944-1945.

J. O. Schaefer, "Two-Color Cartridge Ribbon System with Correction," IBM Technical Disclosure Bulletin, vol. 22, No. 6, Nov. 1979, pp. 2327-2329.

TAPE FEED CONTROL APPARATUS FOR A CORRECTION TAPE CASSETTE FOR A TYPEWRITER

BACKGROUND OF THE INVENTION

1. Field of the Invention

This invention relates to correction tape cassettes for typewriters for correcting mistyped characters, and more particularly concerns tape feed control apparatus for controlling the amount of correction tape being fed to a printing point for lifting-off or covering-up a typewritten character which was typed by mistake.

2. Description of the Prior Art for covering-up a character which has been typed onto a sheet of paper by mistake have been in use for some time. In a typewriter which is using a multi-strike ribbon cassette, a cover-up correction tape cassette is provided which covers-up the mistaken character. In a typewriter which is using a single-strike ribbon cassette, a lift-off correction tape is provided to lift-off the mistaken character.

U.S. Pat. No. 4,900,171 which issued on Feb. 13, 1990 to Mueller and Cappotto, discloses a prior art ribbon cassette and correction tape cassette, and this patent is incorporated herein by reference. This patent discloses means for assuring ink ribbon and correction tape compatibility in a device which utilizes a first cassette having an ink ribbon therein and second cassette having a correction tape therein including a switch means in the device that controls the on-off condition of the device, and means located on one of the cassettes which will activate the on-off switch only when the device contains an ink ribbon in the first cassette which is functionally compatible with the correction tape in the second cassette, such as, for example, functional compatibility between a single-strike ink ribbon and a lift-off correction tape, or functional compatibility between a multiple-strike ink ribbon and a cover-up correction tape.

U.S. Pat. No. 4,886,383, which issued on Dec. 12, 1989, to Mueller, is also incorporated herein by reference. This patent discloses a tape cassette which has a sensing arm pivotally mounted thereon biased against a correction tape on a take-up spool for sensing the amount of correction tape thereon, and a correction tape feed mechanism mounted in a typewriter which has a metering post for engaging the sensing arm at varying locations to cause the correction tape mechanism to feed the correction tape at substantially equal amounts regardless of the amount of correction tape on the take-up spool.

SUMMARY OF THE INVENTION

It is an object of the invention to simplify the constructions and operation of a tape feed control apparatus for a correction tape cassette for a typewriter.

It is an object of the invention to avoid the expense of providing apparatus for sensing the amount of correction tape present on a take-up spool and for feeding a correction tape at substantially equal amounts regardless of the amount of correction tape on the take-up spool.

It is another object of the invention to provide a tape feed control apparatus for a correction tape cassette which has a stop member formed in its housing for limiting the travel of a typewriter metering post into the housing, with the stop member being stationary so that its position does not change in response to the amount of correction tape of the take-up spool, and does not sense the amount of tape on the take-up spool, so that the distance traveled by the metering post corresponds to a constant amount of rotation of the take-up spool no matter whether cover-up correction tape or lift-off correction tape is on the spool, and so that as more and more correction tape winds around the take-up spool, more correction tape is advanced for the same amount of rotation of the take-up spool so that the spacing between characters on the correction tape increases during the life of the correction tape cassette.

DETAILED DESCRIPTION OF THE DRAWINGS

Figure 1:
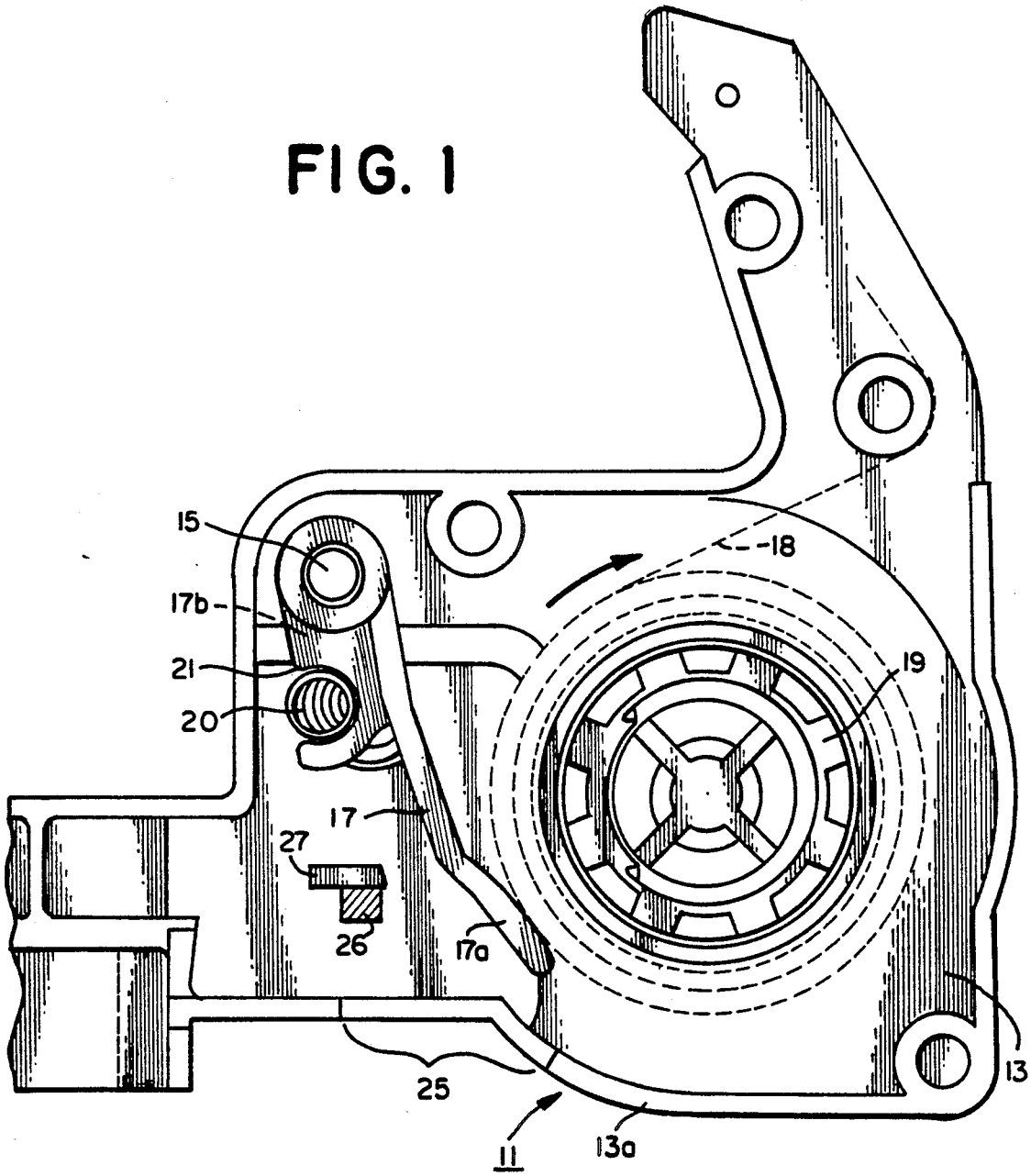
FIG. 1 is a partial view in bottom plan of a correction tape c cassette with its bottom cover removed to show the inside of its housing.

Turning now to the drawings, there is shown tape feed control apparatus for a correction tape cassette 11 for a typewriter for controlling the amount of correction tape that is fed to a printing point for lifting-off or covering-up a typewritten character which has been typed onto a sheet of paper by mistake. The tape feed control apparatus for correction tape cassette 11 comprises a housing 13, a post 15 mounted in the housing 13, and a brake finger 17 pivotally mounted on post 15 so that an end portion 17*a* of the brake finger 17 is in frictional contact with correction tape 18 to hold the tape 18 firmly on a take-up spool 19.

A spring 20 is in contact with brake finger 17 at U-shaped opening 21 to urge brake finger end portion 17*a* against the tape 18 on the take-up spool 19.

An opening 25 is provided in sidewall 13*a* of housing 13 for admitting a typewriter metering post 26 into the housing 13. A stop member 27 is formed in the housing 13 and is positioned so as to limit the travel of typewriter metering post 26 into the housing. Stop member 27 is stationary so that its position does not change in response to the amount of correction tape 18 on the take-up spool 19 so that the distance travelled by the metering post 26 corresponds to a constant amount of rotation of take-up spool 19 no matter whether cover-up correction tape or lift-off correction tape is on spool 19, and so that as more and more correction tape 18 winds around take-up spool 19, more correction tape 18 is advanced for the same amount of rotation of take-up spool 19 so that the spacing between characters on the correction tape 18 increases during the life of the correction tape cassette 11.

Brake finger 17 plays no role in stopping the movement of metering post 26 into housing 13, but acts only as a brake to hold the correction tape 18 firmly on take-up spool 19.

Stop member 27 is in the same location in housing 13 for both lift-off correction tape and cover-up correction tape.

In operation, when a correction is to be made on a typed page to cover-up or lift-off a typewritten character, the typewriter tilts the correction tape cassette 11 upwardly so that the correction tape 18 is placed at the printing point over the typed character to be corrected. After the correction is made, correction tape cassette 11 is lowered to its original position, and as the correction tape cassette 11 is lowered into its original position, metering post 26 moves through opening 25 in sidewall 13*a* into the housing 13 until it contacts the stop member 27. The metering post 26, as is well known in the art, is connected to a take-up spool drive assembly in the typewriter, so that the distance traveled by the metering post 26 corresponds to a certain amount of rotation of take-up spool 19.

Take-up spool 19 is rotated for the same, constant amount no matter how much correction tape is on it. As more and more correction tape winds around take-up spool 19, more correction tape is advanced for the same amount of rotation of take-up spool 19, and as a result the spacing on the correction tape between characters increases during the life of the cassette 11.

Cassette 11 maintains the same character yield as other correction tape cassettes, or increases character yield, by providing an increased amount of correction tape 18 in cassette 11. The increased cost of the additional tape is less than the increased cost which would be incurred if the correction tape cassette were provided with sensing apparatus for sensing the amount of tape on the take-up cassette 19 and feeding a constant length of cassette correction tape after each use of the correction tape to make a correction on a typed character.

The stop member 27 is positioned in the same location in the inventive cover-up correction tape cassettes and in the inventive lift-off correction tape cassettes and this has increased significantly the character yield of the cover-up correction tape cassettes because the spacing between characters on the cover-up tape is closer than in conventional cover-up tape cassettes.

I claim:

1. Tape feed control apparatus for a correction tape cassette 11 for a typewriter for controlling the amount of correction tape being fed to a printing point for lifting-off or covering-up a typed character, comprising a housing having a side wall, a post mounted in the housing, brake finger means pivotally mounted on the post so that an end portion of the brake finger means may make frictional contract with correction tape on a take-up spool for holding the tape firmly on the take-up spool, spring means in contact with said brake finger means for urging the brake finger end portion against the tape on the take-up spool, an opening in the side wall of said housing for admitting a typewriter metering post into the housing, stop means formed in the housing for limiting the travel of the typewriter metering post into said housing, said stop means being stationary and fixed in position in the housing so that its position does not change in response to the amount of correction tape on the take-up spool so that the distance travelled by the metering post corresponds to a constant amount of rotation of the take-up spool no matter whether cover-up correction tape or lift-off correction tape is on the spool, and so that as more and more correction tape winds around the take-up spool, more correction tape is advanced for the same amount of rotation of the take-up spool so that the spacing between characters on the correction tape increases during the life of correction tape cassette.

2. The tape feed control apparatus of claim 1, said brake finger means having a U-shaped opening for receiving the spring that biases the brake finger towards the take-up spool.

3. The tape feed control apparatus of claim 1, said stop means being a stop member fixedly mounted on said housing in the path of the typewriter metering post.

4. A method for controlling the amount of correction tape being fed from a correction tape cassette to a printing point for lifting-off or covering-up a typed character, said method comprising providing a correction tape cassette having:

a housing including a side wall, a post mounted in the housing, a brake finger pivotally mounted on the post so that an end portion of the brake finger may make frictional contact with a correction tape on a take-up spool for holding the tape firmly on the take-up spool, spring means in contact with the brake finger for urging the brake finger end portion against the tape on the take-up spool, an opening in the side wall of the housing for admitting a typewriter metering post into the housing, a stop member formed in the housing for limiting the travel of a typewriter metering post into the housing, said stop member being stationary and fixed in position in the housing so that its position does not change in response to the amount of correction tape on the take-up spool so that the distance travelled by the metering post corresponds to a constant amount of rotation of the take-up spool no matter whether cover-up correction tape of lift-off correction tape is on the spool, and so that as more and more correction tape is advanced for the same amount of rotation of the take-up spool so that the spacing between successive characters on the correction tape increases, tilting the correction tape cassette upwardly so that the correction tape is placed at the printing point over the typed character to be corrected, lowering the correction tape cassette to its original position after the correction has been made, moving the typewriter metering post through the opening in the side wall of the housing into the housing until it contacts the stop member, rotating the take-up spool an amount corresponding to the distance travelled by the metering post to the stop member, rotating the take-up spool each time a correction is made by the same contact amount no matter how much correction tape is on the take-up spool, and increasing the spacing between successive characters on the correction tape each time a correction is made.

5. Tape feed control apparatus for a correction tape cassette for a typewriter for controlling the amount of correction tape being fed to a printing point for lifting-off or covering-up a typed character, comprising a housing having a side wall, a post mounted in the housing, means for holding the tape firmly on the take-up spool and for preventing the spool from rotating backwards, an opening in the side wall of housing for admitting a typewriter metering post into the housing, stop means formed in the housing for limiting the travel of the typewriter metering post into housing, said stop means being stationary and fixed in position in the housing so that its position does not change in response to the amount of correction tape on the take-up spool so that the distance travelled by the metering post corresponds to a constant amount of rotation of the take-up spool no matter whether cover-up correction tape or lift-off correction tape is on the spool, and so that as more and more correction tape winds around the take-up spool, more correction tape is advanced for the same amount of rotation of the take-up spool so that the spacing between characters on the correction tape increases during the life of correction tape cassette.

* * * * *